US009714136B2

(12) United States Patent
Koeling et al.

(10) Patent No.: US 9,714,136 B2
(45) Date of Patent: Jul. 25, 2017

(54) PAD AND ASSEMBLY OF A HOLDER AND SUCH A PAD

(75) Inventors: Hendrik Cornelis Koeling, Amersfoort (NL); Gustaaf Frans Brouwer, Nijkerk (NL)

(73) Assignee: Koninklijke Douwe Egberts B.V., Utrecht (NL)

( * ) Notice: Subject to any disclaimer, the term of this patent is extended or adjusted under 35 U.S.C. 154(b) by 0 days.

(21) Appl. No.: 13/597,003

(22) Filed: Aug. 28, 2012

(65) Prior Publication Data

US 2013/0052305 A1 Feb. 28, 2013

Related U.S. Application Data

(63) Continuation of application No. 11/579,177, filed as application No. PCT/NL2005/000317 on Apr. 28, 2005, now abandoned.

(30) Foreign Application Priority Data

Apr. 28, 2004 (NL) ..... 1026068

(51) Int. Cl.
*A47J 31/00* (2006.01)
*B65D 85/80* (2006.01)
*B65D 85/804* (2006.01)

(52) U.S. Cl.
CPC ..... *B65D 85/8046* (2013.01); *B65D 85/8043* (2013.01)

(58) Field of Classification Search
CPC ..... B65D 85/8043; A47J 31/0678; A47J 31/3695

(Continued)

(56) References Cited

U.S. PATENT DOCUMENTS 1,576,735 A * 3/1926 Fessenden ..... 426/77
2,778,739 A * 1/1957 Rodth ..... A47J 31/0673 426/77

(Continued)

FOREIGN PATENT DOCUMENTS

EP 0 615 921 A1 9/1994
EP 1 510 160 3/2005

(Continued)

OTHER PUBLICATIONS

International Preliminary Report on Patentability Chapter I (IB/373) for PCT/NL2005/000317, Nov. 1, 2006, 9 pages.

(Continued)

*Primary Examiner* — David Angwin
*Assistant Examiner* — Lawrence Samuels
(74) *Attorney, Agent, or Firm* — Foley & Lardner LLP

(57) ABSTRACT

A pad of the optionally flexible, disc-shaped/flat type filled with a product to be extracted and/or a product to be dissolved, provided with an optionally flexible bottom sheet and an optionally flexible top sheet manufactured from, the top sheet and the bottom sheet being interconnected at their longitudinal edges so that a covering with a circumferential sealing seam is formed, with the product situated between the top sheet and the bottom sheet, the bottom sheet and the top sheet each forming a filter which is at least virtually impermeable to the product and which is at least permeable to water, while an area of the covering is designed to be at least virtually impermeable to water, the area comprising, preferably, at least one annular sub-area covering at least a part of the sealing seam, and that the area extends outside the sealing seam at predetermined positions.

58 Claims, 12 Drawing Sheets

(58) Field of Classification Search
USPC .. 99/323.1, 295, 275, 299, 323, 317, 302 R, 99/492; 426/77, 115, 82
See application file for complete search history.

(56) References Cited

U.S. PATENT DOCUMENTS

| | | | | |
|---|---|---|---|---|
| 2,885,290 | A * | 5/1959 | Krasker | A47J 31/02 426/433 |
| 2,968,560 | A | 1/1961 | Goros | |
| 3,425,339 | A | 2/1969 | Fleischman et al. | |
| 3,445,237 | A * | 5/1969 | Gidge | 426/77 |
| 3,450,024 | A | 6/1969 | Martin | |
| 4,446,158 | A | 5/1984 | English et al. | |
| 4,715,274 | A | 12/1987 | Paoletti | |
| 4,718,579 | A | 1/1988 | Brody et al. | |
| 4,801,464 | A | 1/1989 | Hubbard, Jr. | |
| 4,818,544 | A | 4/1989 | Seward | |
| 4,852,333 | A * | 8/1989 | Illy | 53/436 |
| 4,940,304 | A * | 7/1990 | Hatori | 385/7 |
| 4,996,066 | A | 2/1991 | Love et al. | |
| 5,008,013 | A * | 4/1991 | Favre et al. | 210/482 |
| 5,043,172 | A | 8/1991 | Loizzi | |
| 5,082,676 | A * | 1/1992 | Love | B65D 85/8043 426/112 |
| 5,125,327 | A * | 6/1992 | Winnington-Ingram | A47G 19/14 99/306 |
| 5,242,702 | A | 9/1993 | Fond | |
| 5,309,820 | A | 5/1994 | Baxter et al. | |
| 5,398,596 | A | 3/1995 | Fond | |
| 5,402,707 | A * | 4/1995 | Fond et al. | 99/295 |
| 5,424,083 | A * | 6/1995 | Lozito | 426/82 |
| 5,453,189 | A | 9/1995 | Joergensen | |
| 5,454,293 | A | 10/1995 | Santi | |
| 5,472,719 | A | 12/1995 | Favre | |
| 5,567,461 | A * | 10/1996 | Lehrer | 426/417 |
| 5,633,026 | A * | 5/1997 | Gruenbacher | 426/77 |
| 5,656,311 | A * | 8/1997 | Fond | 426/84 |
| 5,738,786 | A * | 4/1998 | Winnington-Ingram | 210/474 |
| 5,762,987 | A | 6/1998 | Fond et al. | |
| 5,840,189 | A * | 11/1998 | Sylvan et al. | 210/474 |
| 5,884,551 | A * | 3/1999 | Orrico | A47J 31/547 219/689 |
| 5,897,899 | A * | 4/1999 | Fond | A47J 31/0678 426/112 |
| 5,948,455 | A * | 9/1999 | Schaeffer | B65D 85/8043 426/112 |
| 6,021,705 | A | 2/2000 | Dijs | |
| 6,026,732 | A * | 2/2000 | Kollep et al. | 99/295 |
| 6,079,315 | A | 6/2000 | Beaulieu et al. | |
| 6,103,116 | A * | 8/2000 | Koslow | A47J 31/06 210/282 |
| 6,250,209 | B1 * | 6/2001 | Pope | 99/323 |
| 6,260,476 | B1 * | 7/2001 | Pope | 99/323 |
| 6,607,762 | B2 * | 8/2003 | Lazaris et al. | 426/79 |
| 6,740,345 | B2 | 5/2004 | Cai | |
| 6,758,130 | B2 * | 7/2004 | Sargent et al. | 99/295 |
| 6,777,007 | B2 | 8/2004 | Cai | |
| 6,810,788 | B2 * | 11/2004 | Hale | 99/295 |
| 6,832,542 | B2 * | 12/2004 | Hu et al. | 99/302 R |
| 6,840,158 | B2 | 1/2005 | Cai | |
| 6,869,627 | B2 * | 3/2005 | Perkovic et al. | 426/77 |
| 6,948,420 | B2 * | 9/2005 | Kirschner | B65D 85/8043 426/77 |
| 7,021,198 | B1 | 4/2006 | Lyall, III | |
| 7,325,479 | B2 | 2/2008 | Laigneau et al. | |
| 7,490,542 | B2 * | 2/2009 | Macchi et al. | 99/295 |
| 7,604,826 | B2 * | 10/2009 | Denisart et al. | 426/77 |
| 7,650,831 | B2 | 1/2010 | Denisart et al. | |
| 7,748,311 | B2 | 7/2010 | Brouwer et al. | |
| 7,910,145 | B2 * | 3/2011 | Reati | 426/77 |
| 7,947,316 | B2 * | 5/2011 | Kirschner et al. | 426/77 |
| 7,964,230 | B2 * | 6/2011 | Kirschner et al. | 426/433 |
| 7,987,768 | B2 * | 8/2011 | Green et al. | 99/280 |
| 8,109,200 | B2 * | 2/2012 | Hansen | 99/295 |
| 8,133,525 | B2 * | 3/2012 | Skalski et al. | 426/590 |
| 8,166,867 | B2 * | 5/2012 | Skalski et al. | 99/280 |
| 8,166,868 | B2 * | 5/2012 | Skalski et al. | 99/290 |
| 8,215,228 | B2 * | 7/2012 | Skalski et al. | 99/280 |
| 8,221,811 | B2 * | 7/2012 | Skalski et al. | 426/115 |
| 8,227,000 | B2 * | 7/2012 | Skalski et al. | 426/115 |
| 8,272,318 | B2 * | 9/2012 | Skalski et al. | 99/279 |
| 8,297,180 | B2 * | 10/2012 | Skalski et al. | 99/279 |
| 8,468,935 | B2 * | 6/2013 | Skalski et al. | 99/300 |
| 8,522,668 | B2 * | 9/2013 | Kirschner et al. | 99/279 |
| 8,590,753 | B2 * | 11/2013 | Marina et al. | 222/325 |
| D694,620 | S * | 12/2013 | Hansen | D9/429 |
| D695,111 | S * | 12/2013 | Hansen et al. | D9/429 |
| D697,797 | S * | 1/2014 | Hansen | D9/429 |
| 8,640,604 | B2 * | 2/2014 | Doglioni Majer | 99/300 |
| 8,658,232 | B2 * | 2/2014 | Yoakim et al. | 426/431 |
| D703,039 | S * | 4/2014 | Hansen | D9/429 |
| D708,057 | S * | 7/2014 | Hansen | D9/429 |
| 8,778,426 | B2 * | 7/2014 | Wen et al. | 426/115 |
| 8,813,634 | B2 * | 8/2014 | Yoakim et al. | 99/302 C |
| 8,850,960 | B2 * | 10/2014 | Biesheuvel et al. | 99/289 R |
| 2001/0053399 | A1 | 12/2001 | Herod | |
| 2002/0015768 | A1 * | 2/2002 | Masek et al. | 426/115 |
| 2002/0078831 | A1 * | 6/2002 | Cai | A47J 31/14 99/295 |
| 2002/0088807 | A1 * | 7/2002 | Perkovic et al. | 220/654 |
| 2003/0096038 | A1 * | 5/2003 | Cai | 426/77 |
| 2004/0005384 | A1 * | 1/2004 | Cai | 426/77 |
| 2004/0228955 | A1 | 11/2004 | Denisart et al. | |
| 2004/0241307 | A1 * | 12/2004 | Knitel | 426/594 |
| 2005/0003060 | A1 | 1/2005 | Steenhof et al. | |
| 2005/0158426 | A1 | 7/2005 | Hu et al. | |
| 2005/0223904 | A1 | 10/2005 | Laigneau et al. | |
| 2008/0105130 | A1 | 5/2008 | Koeling et al. | |
| 2008/0148958 | A1 | 6/2008 | Koeling et al. | |
| 2009/0232944 | A1 * | 9/2009 | MacMahon | B65D 85/8046 426/78 |
| 2009/0272274 | A1 | 11/2009 | De Graaff et al. | |
| 2010/0239733 | A1 | 9/2010 | Yoakim et al. | |
| 2011/0041702 | A1 | 2/2011 | Yoakim et al. | |

FOREIGN PATENT DOCUMENTS

| | | |
|---|---|---|
| EP | 1 848 310 B1 | 11/2009 |
| FR | 2842090 | 1/2001 |
| FR | 2842092 | 1/2004 |
| JP | 61-245828 | 1/1986 |
| JP | 62-268513 | 11/1987 |
| JP | 63-117439 U | 7/1988 |
| JP | 2004696 A | 1/1990 |
| JP | 05-151449 | 6/1993 |
| JP | 06-315437 | 11/1994 |
| JP | 03-029960 U | 10/1996 |
| JP | 10-222748 | 8/1998 |
| NL | 1020833 | 12/2003 |
| WO | WO-96/36557 | 11/1996 |
| WO | WO-00/32291 | 6/2000 |
| WO | WO-00/51478 A1 | 9/2000 |
| WO | WO-02/28241 A1 | 4/2002 |
| WO | WO-03/059778 A2 | 7/2003 |
| WO | WO-2005/018394 A1 | 3/2005 |
| WO | WO-2005/105609 A2 | 11/2005 |
| WO | WO-2005/122851 A1 | 12/2005 |
| WO | WO-2006/006112 A1 | 1/2006 |
| WO | WO-2006/043098 A1 | 4/2006 |
| WO | WO-2006/043103 A1 | 4/2006 |
| WO | WO-2006/043106 A2 | 4/2006 |
| WO | WO-2006/043808 A2 | 4/2006 |
| WO | WO-2006/043808 A3 | 4/2006 |
| WO | WO-2006/078162 A1 | 7/2006 |
| WO | WO-2008/018793 A2 | 2/2008 |

OTHER PUBLICATIONS

Office Action on European Patent Application No. 05740695.1-1708, dated Dec. 16, 2013, 4 pages.

(56) References Cited

OTHER PUBLICATIONS

Machine Translation of JP-63-117439-U provided by the European Patent Office with the Office Action on European Patent Application No. 05740695.1-1708 dated Dec. 16, 2013, 6 pages.
Office Action for Canadian Application No. 2,564,894, mail date Feb. 27, 2014, 2 pages.
International Search Report for PCT/NL2005/000317, Nov. 10, 2005, 6 pages.

* cited by examiner

PAD AND ASSEMBLY OF A HOLDER AND SUCH A PAD

CROSS-REFERENCE TO RELATED PATENT APPLICATIONS

This application is a continuation of application Ser. No. 11/579,177, filed Nov. 15, 2007, which is a National Stage Patent Application of International Patent Application No. PCT/NL2005/000317, filed Apr. 28, 2005, which claims priority to Netherlands Patent Application No. 1026068, filed Apr. 28, 2004, all of which are incorporated herein by reference in their entirety.

BACKGROUND OF THE INVENTION

The invention relates to a pad filled with a product to be extracted such as ground coffee and/or, optionally, a product to be dissolved such as a creamer for preparing a beverage, wherein the pad is designed in order that, in use, a liquid such as hot water can be fed under pressure to the pad for extracting and/or dissolving the product, the pad being provided with an optionally flexible bottom sheet manufactured from, for instance, filtering paper and an optionally flexible top sheet manufactured from, for instance, filtering paper, the top sheet and the bottom sheet being interconnected at their longitudinal edges so that that a covering with a circumferential sealing seam is formed with the product situated between the top sheet and the bottom sheet, the bottom sheet and the top sheet each forming a filter which is at least virtually impermeable to the product and which is at least permeable to water.

The invention also relates to an assembly of a pad and a holder in which the pad is included, wherein the pad is filled with a product to be extracted such as ground coffee and/or, optionally, a product to be dissolved such as a creamer, while the pad is provided with a bottom sheet manufactured from, for instance, filtering paper and a top sheet manufactured from, for instance, filtering paper, the top sheet and the bottom sheet being interconnected at their longitudinal edges in order that a covering with a circumferential sealing seam is formed, with the product situated between the top sheet and the bottom sheet, the bottom sheet and the top sheet each forming a filter which is at least virtually impermeable to the product and which is at least permeable to water, and wherein the holder is provided with a bottom and, optionally, an upstanding sidewall, while in the bottom at least one outflow opening is provided, the pad resting on the bottom while the assembly is designed in order that, in use, a liquid such as hot water can be fed under pressure to the assembly for extracting the pad.

Such a pad and such an assembly are known per se, for instance from the European patent application EP 0 904 717. The known assembly comprises a pad which is filled with a product to be extracted for obtaining an extract and affords possibilities for reducing the risk of bypass and increasing the coffee-making efficiency. Bypass is understood to mean that a liquid such as hot water is fed under pressure to the assembly, of which hot water then at least a part flows around the product in the pad to, thereupon, leave the holder of the assembly via the at least one outflow opening. Such bypass has as a result that, when the pad has for instance been filled with a product to be extracted, the extract which is for instance collected in a cup, is mixed with hot water. This gives the extract an undesired strength. It is not desired to make allowance for such bypass because it is not known beforehand what amount of water will flow to the cup without this being pressed through the bed of the product in the pad. Further, the water has the tendency to choose the path of least resistance, i.e., the water has the tendency to flow through specifically those places of the bed where the bed is relatively thin. This entails that the water flows relatively less through the thicker parts of the bed, resulting in the coffee-making efficiency not being optimal. For this phenomenon too, a solution is given in the European patent application EP 0 904 717.

An unfavourable property of certain embodiments of the known assembly is that the pressure in the holder can rise when the outflow opening becomes clogged. The pressure rises because the beverage cannot leave the holder while hot water is fed under pressure to a top side of the holder.

SUMMARY

The invention contemplates providing a pad allowing, if desired, for an assembly which provides a solution to the drawback mentioned with respect to the rising pressure. The invention also contemplates providing a pad which enables other problems to be solved and/or advantages to be provided as will be further described hereinafter.

The pad according to the invention is accordingly characterized in that one area of the covering is designed to be at least virtually impermeable to water, wherein: —the area comprises at least one annular sub-area occupying at least a part of the sealing seam extending around the sealing seam, which area further extends outside the sealing seam at predetermined positions; —and/or the area comprises a plurality of sub-areas separate from each other; and/or the area comprises at least one sub-area occupying at least a part of the sealing seam and a part of the covering outside the sealing seam. Such a pad can be advantageously used in a holder which is provided with a bottom and, optionally, an upstanding sidewall while in the bottom at least one outflow opening has been provided, the pad resting on the bottom while in the bottom of the holder at least one pressure limit opening is provided. Here, the area of the covering covers the at least one pressure limit opening. If, in use, the holder is closed off with the aid of a lid, whereupon hot water is fed to the holder while moreover, for whatever reason, the outflow opening is clogged, the pressure in the inside space of the holder will not rise to extreme heights because with a rising pressure, hot water and/or the beverage will be discharged via the at least one pressure limit opening. Here, the pressure limit opening and the pad function in combination as a safety valve, which will open when the pressure in the inside space will start to rise as a result of the outflow opening being clogged. Here, the pressure limit opening is covered by the area of the covering which is impermeable to water. If the outflow opening is clogged, the pressure in the holder will rise while the pressure drop across the pad will become very small. The pad is no longer pressed firmly against the bottom. As a result of the rising pressure, the water having been pressed through the pad then flows under the area to the pressure limit opening. The pressure limit opening will start discharging hot water and/or, optionally, the beverage when, for instance, the pressure in the inside space rises to a value above 2 atmosphere. The pressure will then increase no further. Here, for instance each of the sub-areas mentioned can cover a pressure limit opening. Also, as an alternative or in addition thereto, at the predetermined positions, the area, optionally together with the annular sub-area, can cover a pressure limit opening. Also, as an alternative, or in addition thereto, the annular sub-area itself can cover a pressure limit opening. The annular sub-area may further, alternatively or in addition thereto, have the function of reducing bypass and improving the coffee-making efficiency as will be further set forth hereinbelow.

The invention therefore contemplates providing a pad which, at wish, gives an alternative solution to the problem of bypass. The invention further also contemplates providing a pad which, at wish, gives an alternative solution to improving the coffee-making efficiency.

If the area comprises the annular sub-area which occupies at least a part of the sealing seam, the bypass effect, if this should occur, will be reduced. As the area also extends outside the sealing seam at predetermined positions, at wish, additional advantages can be achieved.

Preferably, it holds that the annular sub-area comprises, at the bottom sheet, an annular bottom sheet sub-area which extends inside (i.e. along) and outside the sealing seam. The bed of the product is often relatively thin at positions just outside the sealing seam. Here, the bed has a relatively low flow resistance to water flowing through the bed. This entails that the water tends to flow, to a relatively large extent, through this part of the bed. As a result, the efficiency will not be optimal. As the area comprises an annular bottom sheet sub-area which also extends outside the sealing seam, the efficiency of the pad can be improved.

It is also possible that at the annular sub-area comprises, at the bottom sheet, an annular bottom sheet sub-area which extends along the sealing seam and occupies at least a part of the sealing seam, while the area at the bottom sheet further comprises parts forming bulges at an inside edge of the bottom sheet sub-area outside the sealing seam. Here, the annular bottom sheet sub-area can reduce the bypass problem while, for instance, each bulge, optionally together with the annular bottom sheet sub-area, can cover the pressure limit opening.

In particular, it further holds that the bottom sheet comprises an annular bottom sheet part of which first ring segments form part of the area of the covering and of which second ring segments do not form part of the area of the covering, the first and second ring segments together forming the annular bottom sheet part, while the annular bottom sheet part extends along the sealing seam and occupies at least a part of the sealing seam.

In particular, it further holds here that the top sheet comprises an annular top sheet part of which first ring segments form part the area of the top sheet and second ring segments do not form part of the area of the top sheet, the first and second ring segments of the annular top sheet part together forming the annular top sheet part, while the annular top sheet part extends along the sealing seam and occupies at least a part of the sealing seam. All this can be provided such that the first ring segments of the top sheet and the first ring segments of the bottom sheet, in combination, form the annular sub-area which occupies at least a part of the sealing seam.

In particular it holds that at the area at the bottom sheet comprises a first strip-shaped bottom sheet sub-area that extends along at least a part of a diameter of the bottom sheet. The first strip-shaped bottom sheet sub-area allows use of the pad in a holder with two separate discharge paths for the preparation of, for instance, two cups of the beverage. The holder may be provided with an inside space bound by a bottom and an upstanding sidewall. This inside space can be subdivided into two sub-spaces by means of a partition wall. On this partition wall, the first strip-shaped bottom sheet may rest. Each sub-space of the holder can be provided with at least one outflow opening. When, thus, hot water is fed to a top side of the holder, this hot water will be pressed through the pad. The beverage formed will then leave the pad and will divide itself, for the most part equally, over both sub-spaces.

The assembly according to the invention is characterized in that in the bottom, further, at least one pressure limit opening is provided while the bottom sheet of the pad is provided with at least one area which is impermeable to water and which covers the at least one pressure limit opening.

If, in use, the holder is closed off with the aid of a lid, whereupon hot water is fed to the holder while, moreover, for whatever reason, the outflow opening is clogged, the pressure in the inside space of the holder will not rise to extreme heights because, with a rising pressure, hot water will be discharged to a surrounding outside the holder via the at least one pressure limit opening. Here, the pressure limit opening and the pad function in combination as a safety valve which will open when the pressure in the inside space will start to rise as a result of the outflow opening being clogged. Here, the pressure limit opening is covered by the area of the covering which is impermeable to water. If the outflow opening is clogged, the pressure in the holder will increase, while the pressure drop across the pad will then become very small. The pad is no longer firmly pressed against the bottom. The water that has been pressed through the pad then flows under the area to the pressure limit opening as a result of the increasing pressure. Then, the pressure limit opening will start discharging hot water when, for instance, the pressure in the inner space increases to a value above three atmosphere. The pressure will then rise no further. In particular, it further holds that the pad is provided with a plurality of indentations located at an outside edge of the sealing seam. In that case, with the assembly, the bottom of the holder is provided, preferably, with projections reaching into the indentations. In this manner, the pad can be positioned accurately at a desired, predetermined position in the holder such, for instance, that the area of the covering covers the at least one pressure limit opening. This accurate positioning is, for instance, particularly important when the pad is provided with the indentations for covering the pressure limit opening.

It is also possible that the sealing seam is provided with a plurality of openings which extend from a top side of the pad to a bottom side of the pad. Preferably, the openings are located in the area of the covering. With this variant too, it holds for the assembly that it is preferred that the bottom of the holder be provided with projections reaching into the openings. For this variant too, it holds that thus, the pad can be accurately positioned at a predetermined position within the holder, the arrangement being such that when, for instance, the holder is provided with the at least one pressure limit opening, this pressure limit opening is covered by the area of the covering.

Preferably, it further holds that a through-flow surface of the at least one pressure limit opening is greater than a through-flow surface of the at least one outflow opening. In this manner, when the pressure in the holder starts rising as a result of a clogging of the outflow opening, the pressure can be reduced rapidly when the pressure limit opening opens. The fact is that the through-flow opening has a relatively great through-flow surface.

BRIEF DESCRIPTION OF THE DRAWINGS

The invention will presently be further elucidated with reference to the drawing. In the drawing.

DETAILED DESCRIPTION

Figure 1:
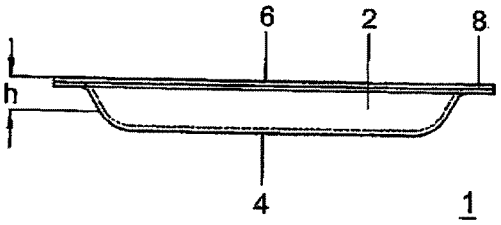
FIG. 1 shows a side view of a pad according to the invention.

In FIG. 1, reference numeral 1 indicates a pad. In this example, the pad is designed in order that, in use, a liquid such as hot water can be fed under pressure to the pad for the purpose of being pressed through the pad. The pad 1 is filled with a product to be extracted such as ground coffee and/or a product to be dissolved such as a creamer. The product can be extracted with a liquid such as, for instance, water or be dissolved in water. However, the invention does not preclude other liquids than water to be fed under pressure to the pad for extracting or dissolving the product. For instance, also milk can be fed for extracting the product such as, for instance, ground coffee. Milk can also be fed for dissolving the product (such as for instance cocoa). The fact that the cocoa may not completely dissolve falls within the framework of this invention.

The product is indicated with reference numeral 2. The pad is provided with a preferably flexible bottom sheet 4 and a preferably flexible top sheet 6. The top sheet and the bottom sheet are interconnected at their longitudinal edges in a manner known per se so that a covering 4, 6 with a circumferential sealing seam 8 is formed. The product 2 is situated between the top sheet and the bottom sheet in the covering formed by the top sheet and the bottom sheet. Both the top sheet and the bottom sheet each form a filter which is, at least virtually, impermeable to the product and which is, as explained hereinabove, at least permeable to water.

An area 10 (represented in hatching) of the covering 4, 6 is designed to be at least virtually impermeable to water. This area comprises an annular sub-area 12 which occupies at least a part of the sealing seam 8 and which area further extends outside the sealing seam 8 at predetermined positions.

A possible example of such an area 10 is discussed hereinbelow with reference to FIG. 2*a* and FIG. 2*b*. FIG. 2*a* shows a bottom view of the bottom sheet 4 of the pad of FIG. 1. For clarity's sake it is noted that the sealing seam 8 in this example has a width d2. In this example, the area 10 extends in any case at the bottom sheet 4. The annular sub-area 12 of the area 10 comprises at the bottom sheet an annular bottom sheet sub-area 14 having a width d1. The sealing seam 8 has a width d2 which is smaller than the diameter d1. In this example, the annular bottom sheet sub-area 14 occupies the entire sealing seam 8 and extends over a distance d1 minus d2 along the bottom sheet 4 on positions 15 of the bottom sheet 4 located outside the sealing seam 8. Hence, the annular sub-area 12 extends outside the sealing seam 8 at predetermined positions 15 and occupies at least a part of the sealing seam 8. This part of the sealing seam extends around the sealing seam and is, consequently, also annular. In this example, this part forms the entire sealing seam. This entails that besides the sealing seam 8, also a part of the bottom sheet adjacent the product 2 is designed to be impermeable to water. Here, it may be so that the area 10 does not extend over the top sheet 6. Therefore, the area 10 comprises an annular sub-area 12, occupying at least one part of the, and in this example the entire, sealing seam. Further, the area 10 extends outside the sealing seam at predetermined positions. In this example, these positions 15 are defined by the part of the annular sub-area 12 which extends outside the sealing seam.

In this example, it holds that the top sheet 6 is designed to be at least virtually flat. It further holds that the bottom sheet 4 is of cup-shaped design, as is clearly visible in FIG. 1.

Figure 6A:
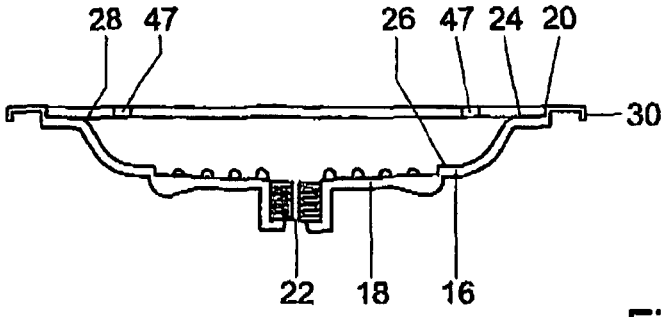
FIG. 6*a* shows a cross-section of a holder for including a pad according to the invention.

The pad according to FIG. 2*a* can for instance be included in a holder as shown in FIG. 6*a*. The holder 16 is provided with a bottom 18 and an upstanding sidewall 20. The holder 16 can for instance be designed as described in the European patent application EP 0 904 717. In the bottom 18, at least one outflow opening 22 is provided. In this example, the bottom 18 is composed of a horizontal, annular outside bottom part 24 and a dish-shaped inside bottom part 26. The inside bottom part 26 borders on an inside edge 28 of the outside bottom part 24 while the inside bottom part adjacent the outside bottom part extends downwards in a direction away from a side 30 of the holder. In the bottom, grooves 32 are provided, formed between projections 34, the grooves extending from a position at a distance from the sidewall in a direction away from the sidewall.

Figure 7:
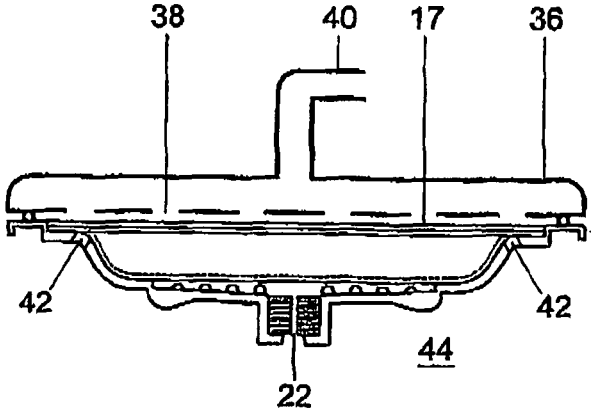
FIG. 7 shows a cross-section of a first embodiment of an assembly according to the invention comprising a holder according to FIGS. 6*a* and 6*b* and a pad according to the invention, which is included in the holder.

In use, the pad according to FIG. 2*a* is placed in the holder, as shown in FIG. 7. In this example, the pad reaches adjacent the upstanding sidewall. The holder with the pad 1 included therein is closed off by a lid 36. The lid 36 is provided at its inside with a plurality of hot water outlet openings 38. The lid is further provided with a water inlet 40 which is in fluid communication with the water outlet openings 38. In use, hot water is fed under pressure to the water inlet 40. The pressure may for instance be 0.7 bar. This hot water flows via the outlet openings 38 into the inside space 17 of the holder. The water is thus fed under pressure to a top side of the pad 1. As the pad is provided with the bottom sheet sub-area 14 which is non-transmissive to water, water cannot leave the pad at these positions. In an annular part 15 of the bottom sheet sub-area 14, having a diameter d1-d2, and located just outside the sealing seam 8, the height h (see FIG. 1) of the product 2, in this example the coffee bed, is relatively small. Here, the water that is pressed through the pad therefore experiences a relatively small flow resistance from the coffee. The result would be that relatively much water is pressed through this part of the coffee bed while this is the very part of the coffee bed that comprises the least coffee. As a result, the coffee-making efficiency would decrease. Since, however, it holds that the bottom sheet sub-area 14 also renders the annular area 15 of the bottom sheet non-transmissive to water, the water cannot leave the pad at these positions, and a relatively large amount of water is prevented from passing through the relatively thin part of the coffee bed. The coffee-making efficiency of the pad according to FIG. 2*a* is improved. It is also precluded that the water is pressed through the sealing seam 8 because in this example, the sealing seam 8 itself is also impermeable to water. The fact is that the annular sub-area 12 comprises, at the bottom sheet, the annular bottom sheet sub-area 14 occupying the entire sealing seam 8. As a result thereof, the risk of bypass is reduced. Bypass is understood to mean that water, fed to a top side of the pad, flows around the coffee bed to the outflow opening 22 of the holder.

In this example, water is also prevented from flowing around the pad to the outflow opening 22, since the pad, at the locations where, as a result of a pressure drop across the pad, it is pressed onto the bottom, it forms a seal to water. Hence, in the present example, the bottom sheet sub-area 14 provides an additional guarantee against the risk of bypass and an extra guarantee for the improvement of the coffee-making efficiency.

In the example of the assembly of FIG. 7, in the bottom, further, a number of pressure limit openings 42 are provided, providing a fluid communication between the inside space 17 and the surroundings 44 of the holder. The pressure limit openings 42 are each located partly in the outside bottom part 24 and partly in the inside bottom part 26. Hence, they are located on the inside edge 28. It further holds that each of the pressure limit openings 42 is covered by the area 10 of the bottom sheet 4, in this example by the annular bottom sheet sub-area 14. All this entails the following advantage. If in the assembly of FIG. 7 the outflow opening 22 becomes clogged, when the water is fed to the water inlet 40 of the lid, the pressure in the inside space 17 of the holder will start rising rapidly when the coffee extract, which is pressed through the pad 1, cannot leave the inside space 17 via the outflow opening 22. Further, the pressure drop across the pad will decrease so that the pad is no longer pressed against the bottom in an effective manner. It proves to be such that, with an increasing pressure of the liquid (coffee extract and/or water) in the inside space 17, the bottom sheet 14 no longer closes off the pressure limit openings 42 so that the liquid can leave the inside space 17 via the pressure limit openings. As a result, a safety measure is built in, in order that the pressure in the inside space 17 cannot rise too much. In normal operation, when the outflow opening 22 is not blocked, as a result of the pressure drop across the pad, the bottom sheet and hence the part of the bottom sheet 4 which is non-transmissive to water will be pressed against the bottom. As a result, the part of the bottom sheet which is non-transmissive to water will close off the pressure limit openings so that in that case, the coffee extract leaves the holder only via the outflow opening 22. In particular, it will hold that here, the outflow opening 22 is designed as, for instance, a nozzle. It holds in this example that the size of the through-flow surface of the outflow opening 22 is smaller than the size of the through-flow surface of each of the pressure limit openings 42. If the holder were provided with a plurality of outflow openings 22, it holds that for instance the sum of the through-flow surfaces of the outflow openings 22 is smaller than the sum of the through-flow surfaces of the pressure limit openings 42.

Figure 15A:
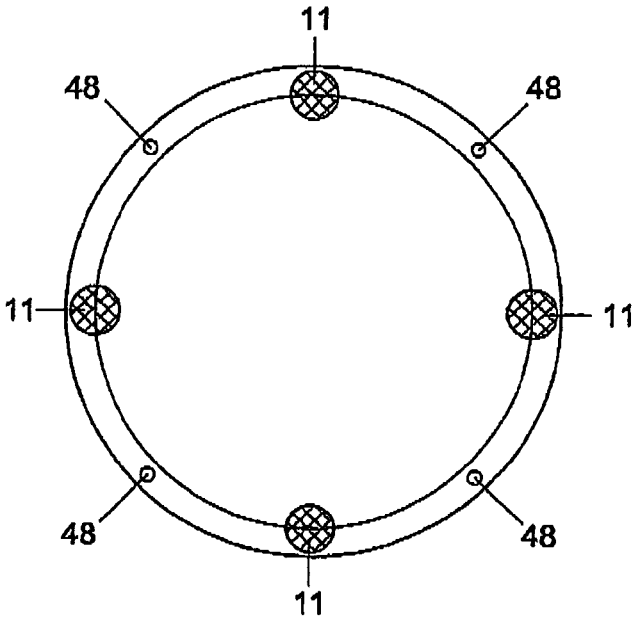
FIG. 15*a* shows a bottom view of a ninth embodiment of a pad according to the invention.

The pressure limit openings 42 can also each be provided entirely in the inside bottom part or in the outside bottom part of the holder. For the cooperation between pad and holder as regards the pressure limit openings, it is further not required that the area 10 comprises the annular sub-area 12. At the bottom sheet, the area 10 needs only be present those specific positions for the pressure limit openings to be closed off. To this end, the area 10 may consequently be provided with a plurality of sub-areas, separate from each other, with each sub-area closing off one of the pressure openings, or wherein in any case a combination of the sub-areas closes off the pressure limit openings. FIG. 15*a* shows a bottom side of a pad with such sub-areas 11, with each sub-area closing off a pressure limit area when the pad in this example is placed in the holder of FIG. 7. Thereto, each sub-area can have a size that is greater than the pressure limit opening which is closed off by the respective sub-area. Again, a side view of the pad according to FIG. 15 is shown in FIG. 1. With the variant according to FIG. 15*a*, it also holds that the area comprises at least one (in this example four) sub-area(s) occupying at least a part of the sealing seam and a part of the covering outside the sealing seam.

Figure 15B:
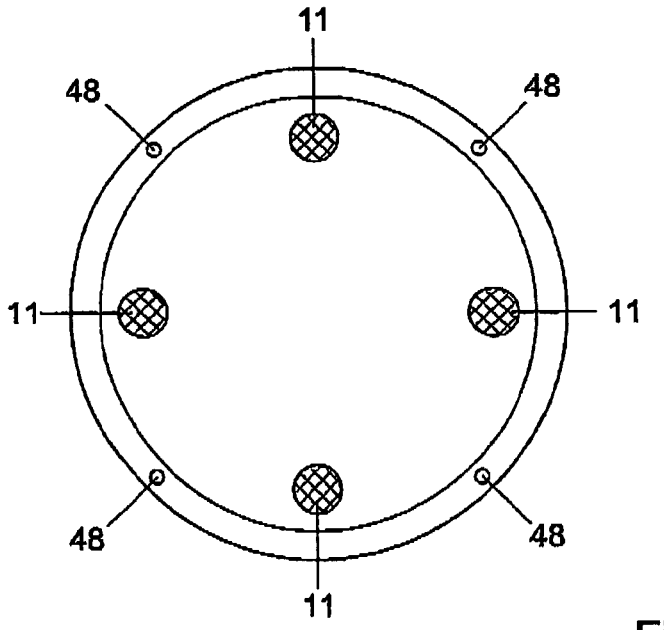
FIG. 15*b* shows a bottom view of a tenth embodiment of a pad according to the invention.
Figure 15C:
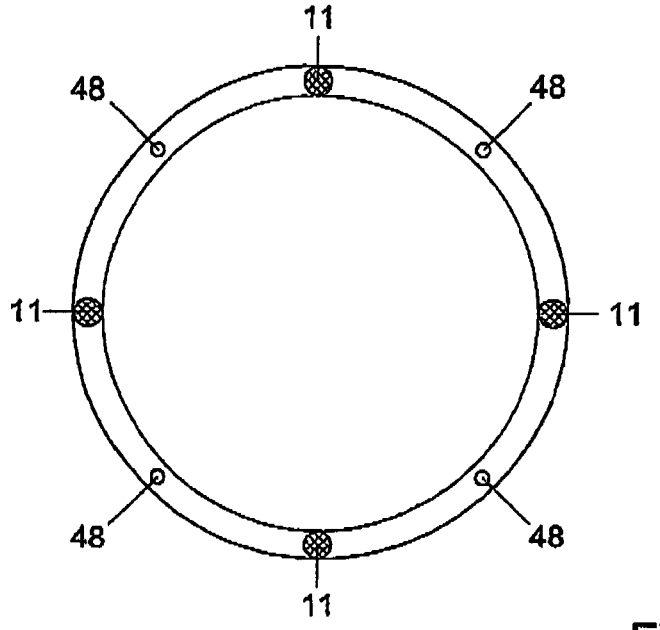
FIG. 15*c* shows a bottom view of an eleventh embodiment of a pad according to the invention.

If the pressure limit openings 47 lie completely in the inside bottom part 26, the sub-areas 11 can extend entirely along the bottom sheet 4 outside the sealing seam 8 (FIG. 15*b*). If the pressure limit openings lie completely in the outside bottom part 24, the sub-areas 11 can extend entirely along (within) the sealing seam of the bottom sheet 4 (FIG. 15*c*).

It is preferred that the surface of the sub-area 11 be greater than the surface of a pressure limit opening which is covered by the respective sub-area 11. Each length of a diameter of a sub-area is for instance 50-150% greater than a corresponding diameter of a pressure limit opening.

Figure 6B:
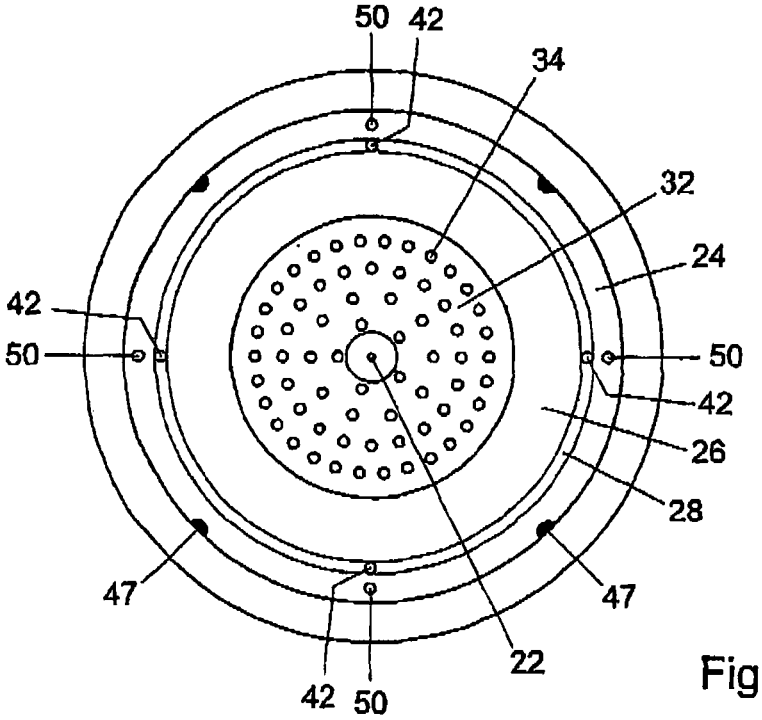
FIG. 6*b* shows a top plan view of the holder of FIG. 6*a;*

With the pad according to FIGS. 1 and 2*a*/2*b* it further holds that the sealing seam is provided with a plurality of indentations 46 located at an outside edge of the sealing seam. The indentations are situated in the area 10 of the bottom sheet 4. In this example, the area 10 of the bottom sheet as discussed hereinabove is formed by the bottom sheet sub-area 14. As can be seen in FIGS. 6 and 7, it holds in this example that the bottom of the holder is provided with projections 47 reaching, in use, into the indentations 46. In this manner the pad can be accurately positioned in a desired position in the holder. Such indentations can be used entirely analogously with the pad according to FIG. 15.

Figure 2B:
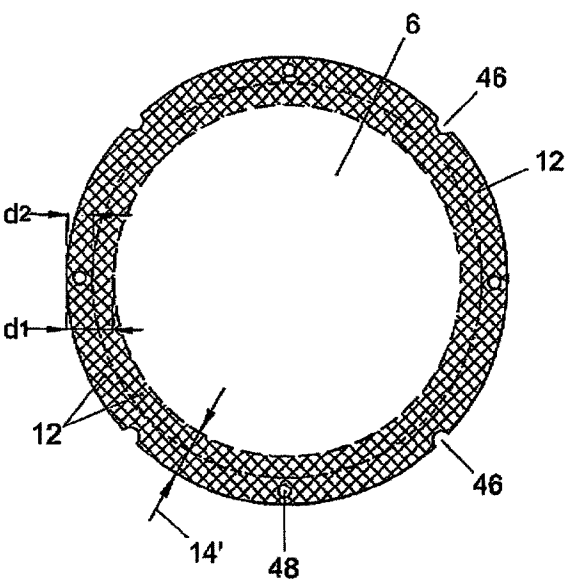
FIG. 2*b* shows a top plan view of the pad according to FIG. 2*a;*
Figure 2A:
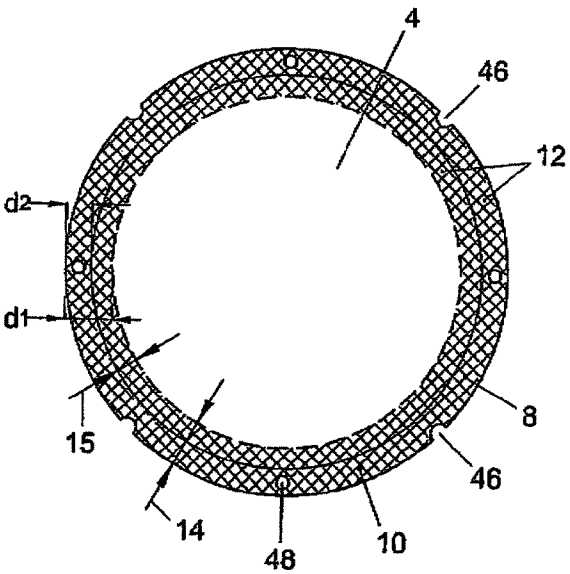
FIG. 2*a* shows a bottom view of a first embodiment of a pad according to the invention.

Instead of having indentations 46, or in combination with indentations 46, the pad according to FIGS. 2*a*, 2*b* or according to FIG. 15 can also be provided with a plurality of fixing openings 48 extending from a top side of the pad to a bottom side of the pad. The fixing openings 48 are situated in the sealing seam 8. In this example, with the pad according to FIGS. 2*a*/2*b*, it further holds that the fixing openings are situated in the area 10 of the bottom sheet, i.e. in the bottom sheet sub-area 14.

Figure 8B:
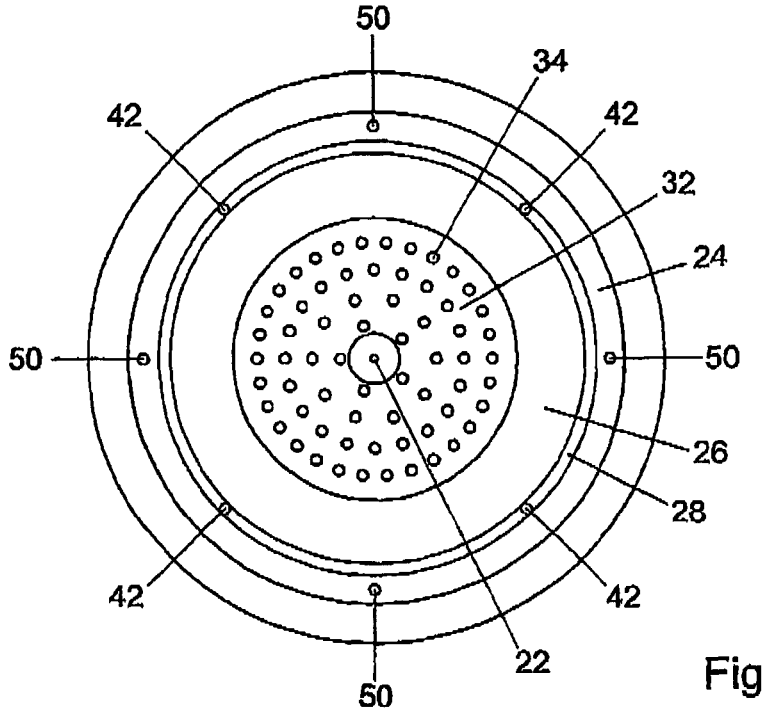
FIG. 8*b* shows a top plan view of the holder according to FIG. 8*a;*
Figure 8A:
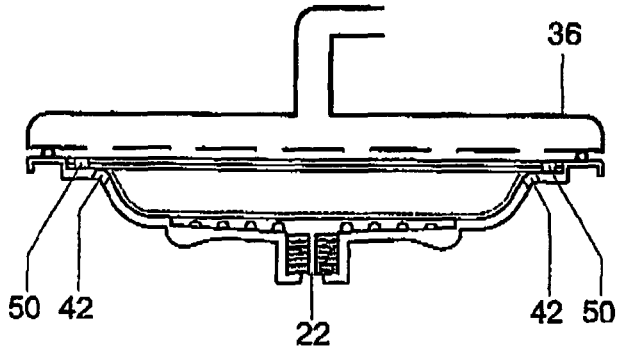
FIG. 8*a* shows a cross-section of a second alternative embodiment of an assembly according to the invention.

With a pad having fixing openings, use can be made of a holder as shown in FIG. 8 and FIG. 8*b*. The holder of FIG. 8 corresponds to a large extent to the holder according to FIGS. 6 and 7 with this distinction that the holder according to FIG. 8 is not provided with projections 47 but, instead thereof, is provided with projections 50 extending, in use, through the fixing openings 48 of the pad. The projections 50 are projections of the bottom 18 of the holder. More in particular, the projections 50 are been provided at the outside bottom part 24. In particular it further holds that the projections 50 have a diameter which is somewhat greater than de diameter of the fixing openings 48 so that the projections 50 can reach into the fixing openings 48 in a more or less clamping manner. In this manner too, it is guaranteed that the pad is positioned in the holder at a desired position before the holder is closed off with the aid of the lid 36 for the preparation of, in this example, coffee, as is discussed with reference to FIG. 7. With the pad according to FIG. 15, the fixing opening 48 also ensure that when the projections reach into the fixing openings, the pad is positioned in the holder according to FIGS. 8*a*/8*b* such that the sub-areas 11 cover the pressure limit openings 42. The fixing openings of the pad of FIG. 15 can cooperate with the projections of the holder according to FIGS. 8*a*, 8*b*. It will be clear that the fixing openings of the pad of FIG. 15 have to be arranged rotated through 45 degrees in the plane of the drawing relative to the pad so that they are located at the sub-areas 11 in order that the pad can also be used in the holder according to FIGS. 6*a* and 6*b*.

As stated, the top sheet 6 of the pad according to FIG. 2*a* can be designed so as to be of, merely, filtering paper, with the area 10 not extending as far as the top sheet. However, as shown in FIG. 2*b*, it is also possible that the annular sub-area 12 comprises an annular top sheet sub-area 14' having a similar diameter d1 as discussed in relation to FIG. 2*a*. It therefore holds here that the annular top sheet sub-area 14' also occupies the entire sealing seam 8. Furthermore, the annular top sheet sub-area reaches outside the sealing seam, more particularly so over a distance d1-d2 as can be seen in FIG. 2*b*.

If the top sheet is designed as discussed with reference to FIG. 2*b*, the bottom sheet sub-area 14 can, if desired, be omitted. Here, use can be made of a holder as shown in FIG. 6*a*.

Figure 3B:
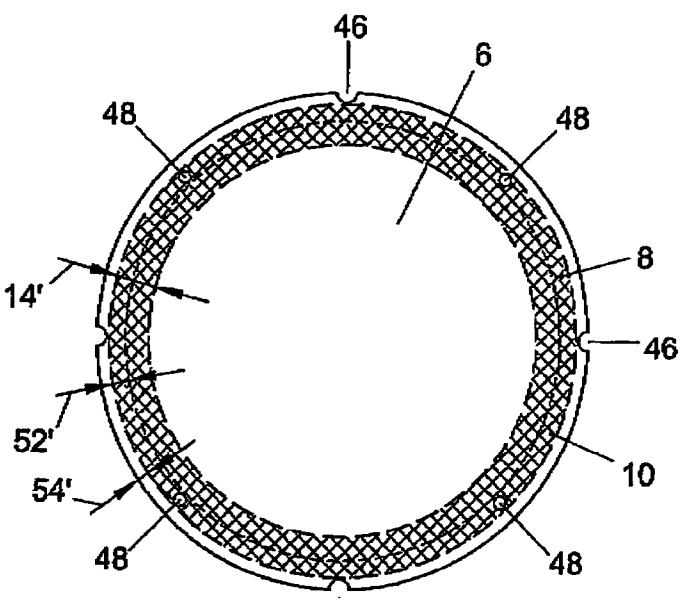
FIG. 3*b* shows a top plan view of the pad according to FIG. 3*a;*
Figure 3A:
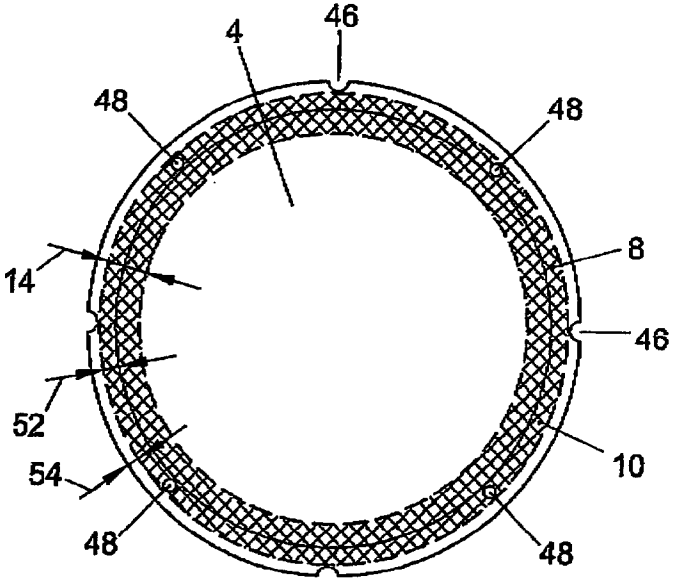
FIG. 3*a* shows a bottom view of a second embodiment of a pad according to the invention.

As shown in FIG. 3*a*, it may also be such that the annular bottom sheet sub-area 14 occupies only a part of the sealing seam 8. In the example of FIG. 3*a*, the annular bottom sheet sub-area 14 occupies a first annular seam part 52 of the sealing seam 8. The sealing seam 8 comprises a second annular seam part 54 which embraces the first annular seam part 52 and does not form part of the area 10 of the bottom sheet 6 which is at least virtually water impermeable. For the pad according to FIG. 3*a* it holds that this too can be provided with indentations 46 and/or fixing openings 48 as discussed in relation to FIG. 2*a*. Preferably, the fixing openings 48 extend in the first annular seam part 52. The area 10 may, again, not extend over the top sheet 6 as discussed in relation to FIG. 2*a*. However, it is also possible that the area 10 comprises, at the top sheet 6, an annular top sheet sub-area 14' reaching outside the sealing seam 8. Here, it holds in particular that the annular top sheet sub-area 14' covers a part of the sealing seam 8. The annular top sheet sub-area 14' then occupies, for instance, a fifth annular seam part 52' of the sealing seam 8. The sealing seam further comprises a sixth annular seam part 54' which does not form part of the area 10 of the top sheet which is at least virtually impermeable to water. The sixth annular seam part embraces the fifth annular seam part.

Naturally, the pad of FIG. 1 can also be provided with the bottom sheet according to FIG. 2*a* and the top sheet according to FIG. 3*b*. It is also possible that the pad of FIG. 1 is provided with the bottom sheet according to FIG. 3*a* and the top sheet according to FIG. 2*b*. Such variants are all possible. In the example of FIG. 3*a*, the fixing opening is provided in the first annular seam part 52. However, this is not necessary. They could also have been provided in the second annular seam part 54.

Figure 4B:
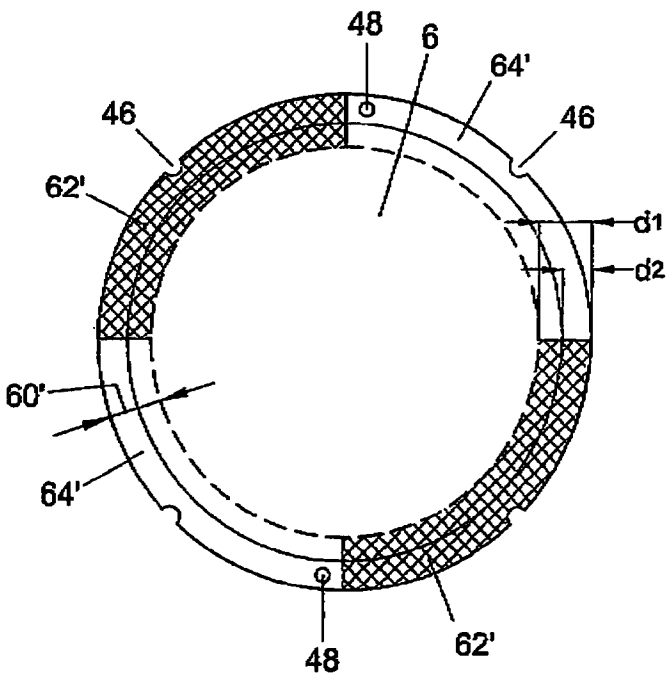
FIG. 4*b* shows a top plan view of the pad according to FIG. 4*a;*
Figure 4A:
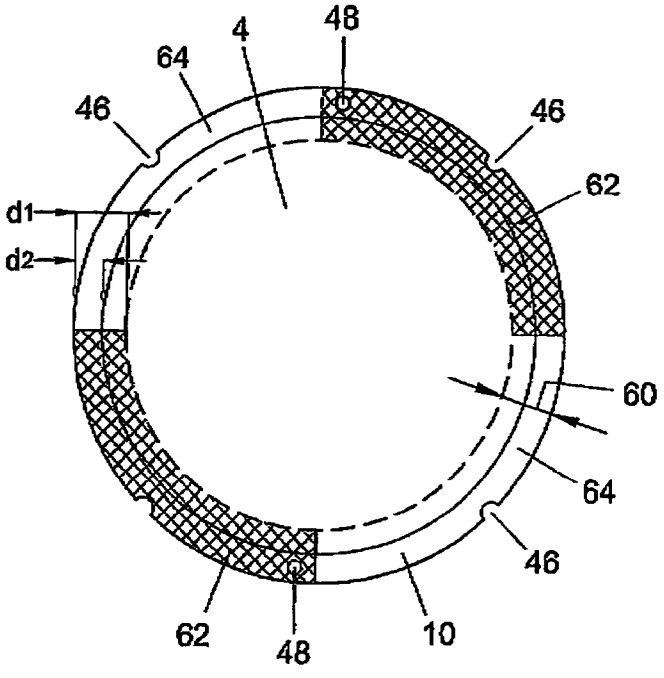
FIG. 4*a* shows a bottom view of a third embodiment of a pad according to the invention.

The pad of FIG. 1 could also be provided with a bottom sheet according to FIG. 4*a* and a top sheet as shown in FIG. 4*b*.

The bottom sheet of FIG. 4*a* comprises an annual bottom sheet part 60, of which first ring segments 62 form part of the area 10 of the covering, and of which second ring segments 64 do not form part of the area 10 of the covering. The first and second ring segments 62, 64 together form the annual bottom sheet part 60. As can be seen in FIG. 4*a*, one segment 62 of the first segments 62 borders on both sides on segments 64 of the second segments 64. The annular bottom sheet part 60 occupies at least a part of the sealing seam 8. In this example, the annular bottom sheet part occupies the entire sealing seam 8. Furthermore, it holds that the annular bottom sheet part 60 extends inside and outside the sealing seam 8. This appears from the fact that the annular bottom sheet part has a width which is equal to d1 while the sealing seam has a width which is equal to d2, with d2 being smaller than d1 (see FIG. 4*a*).

The top sheet 6 of the pad according to FIG. 4*a* can be designed as shown in FIG. 4*b*. The top sheet 6 comprises an annular top sheet part 60'. The annular top sheet part 60' comprises first ring segments 62', forming part of the area 10 of the top sheet 6, and second ring segments 64' not forming part of the area 10 of the top sheet. The first and second ring segments 62', 64' together form the annual top sheet part 60'. The annular top sheet part 60' extends along the sealing seam 8 and occupies at least a part of the sealing seam 8. Further, entirely analogously to what is described with reference to FIG. 4*a*, it holds that one segment 62' of the first segments 62' of the annular top sheet part 60' borders, on both sides, on segments 64' of the second segments 64' of the annular top sheet part 60'. In this example, the annular top sheet part 60' occupies the entire sealing seam 8. It further holds that the annular top sheet part extends both inside and outside the sealing seam. This can, again, be understood now that the thickness d1 of the sealing seam is smaller than the thickness d2 of the top sheet part 60'.

The top sheet and the bottom sheet are interconnected such that the segments 64 lie opposite the segments 62' while the segments 62 lie opposite the segments 64'. The segments 62 and 62' then provide, in combination, the annual sub-area 12 of the covering which occupies at least a part of the, and in this example the entire, sealing seam and which area further extends outside the sealing seam at predetermined positions.

The pad according to FIGS. 4*a* and 4*b* has a side view as shown in FIG. 1 and can, again, be provided with indentations 46 and/or fixing openings 48 as discussed hereinabove.

Figure 4D:
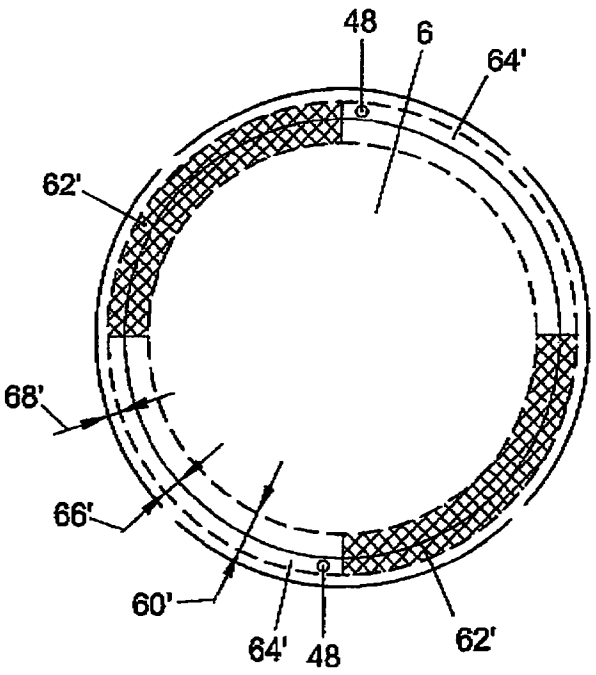
FIG. 4*d* shows a top plan view of the pad according to FIG. 4*c;*
Figure 4C:
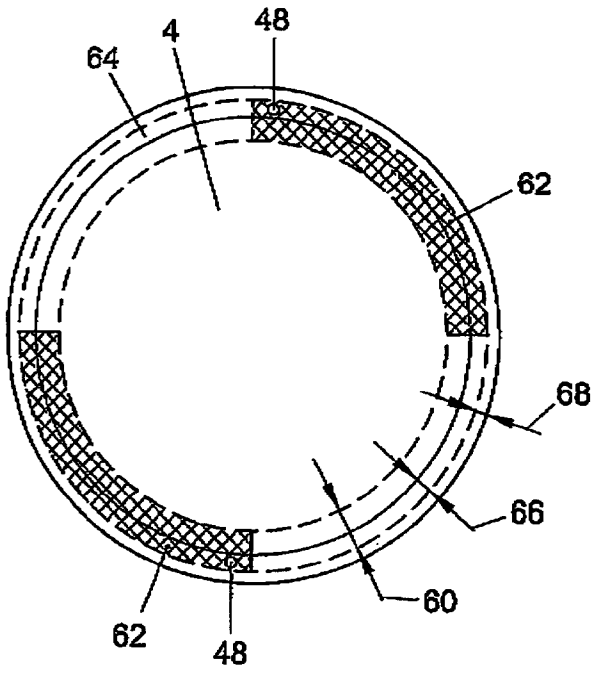
FIG. 4*c* shows a top plan view of a fourth embodiment of a pad according to the invention.

With all this being analogous to what is discussed with reference to FIGS. 3*a* and 3*b*, as shown in FIG. 4*c*, the annular bottom sheet part 60 can occupy only a part of the sealing seam 8. Here, the annular bottom sheet part 60 occupies, for instance, a third annular seam part 66 of the sealing seam 8. The sealing seam 8 further comprises a fourth annular seam part 68 embracing a third annular seam part 66 and not forming part of the area 10 of the bottom sheet which is at least virtually impermeable to water. The top sheet 6 can be built up entirely analogously to what is discussed with reference to FIG. 4*c*. For the top sheet 6 of FIG. 4*d* it holds that the annular top sheet part 60' occupies a part of the sealing seam 8. The annular top sheet part occupies a seventh annular seam part 66' of the sealing seam 8. The sealing seam further comprises an eighth annular seam part 68' which embraces the seventh annular seam part and does not form part of the area of the top sheet which is least virtually impermeable to water. For the pad according to FIGS. 4*c* and 4*d* too, it holds that the segments 64 and 62' lie opposite each other and that the segments 62 and 64' lie opposite each other in order to thus form a pad of which a side view corresponds to that shown in FIG. 1. Here, too, it holds that the segments 62 and 62', in combination, form the annular sub-area 12 of the covering, having the property that this annular sub-area occupies at least a part of the sealing seam, while, moreover, this annular sub-area provides that, further, the area 10 extends outside the sealing seam at predetermined positions. The pad according to FIGS. 4*c* and 4*d* too can be provided with indentations and/or fixing openings as discussed hereinabove.

Figure 5:
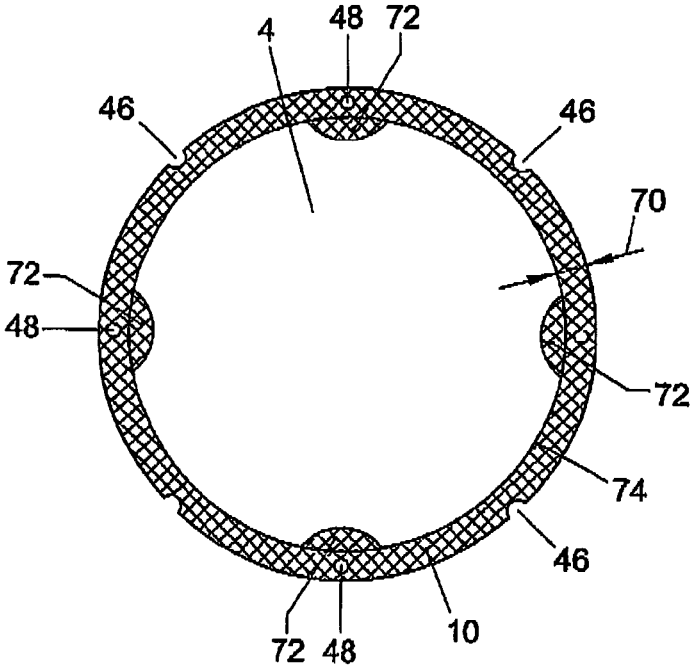
FIG. 5 shows a bottom view of a fifth embodiment of a pad according to the invention.

In FIG. 5, an alternative embodiment of a bottom sheet 4 of the pad 1 of FIG. 1 is shown. The annular sub-area 12 comprises at the bottom sheet an annular bottom sheet sub-area 70 which extends along the sealing seam and occupies at least a part of the sealing seam. In this example, the annular bottom sheet sub-area 70 occupies the entire sealing seam 8 and, as to this, is comparable to the annular bottom sheet sub-area 14 of FIG. 2*a*. In FIG. 2*a*, the annular bottom sheet sub-area 14 also had the property that it reached outside the sealing seam 8. This is not the case with the variant according to FIG. 5. Instead thereof, the area 10 further comprises, at the bottom sheet, parts forming bulges 72 at an inside edge 74 of the bottom sheet sub-area 70 outside the sealing seam. The bulges 72 are therefore the earlier mentioned parts of the area 10 extending outside the sealing seam at predetermined positions. Here, it holds therefore that the width d1 of the annular bottom sheet sub-area 70 is equal to the width d2 of the sealing seam 70.

The top sheet of the pad of FIG. 5 can comprise an area 10 similar to the bottom sheet 4 of FIG. 5. A top plan view of such a sheet will therefore be identical to the bottom view of the bottom sheet 4.

In this example, the pad according to FIG. 5 can, again, be provided with fixing openings 48 and/or indentations 46. If such a pad is placed in the holder according to FIG. 6*b* such that the projections 50 fall into the fixing openings 48 and/or such that the projections 47 fall into the indentations 46, the annual sub-area 70 of the bottom sheet and the bulges 72 of the bottom sheet ensure that the pressure limit openings 42 are covered. During normal use, the pressure limit openings 42 are therefore closed off by areas of the covering which are impermeable to water. In use therefore, the water will be pressed through the pad 1 whereupon the coffee extract can leave the pad via the outflow opening 22. Only when the pressure in the inside space of the holder starts to rise to an extreme degree, if, for instance, the outflow opening 22 is clogged, the liquid will leave the inside space via the pressure limit openings 42 as discussed hereinabove. If the pad were placed in the holder such that the projections 50 do not fall into the fixing openings 48, the possibility exists that the bulges do not (partly) close off the pressure limit openings 42. The fixing openings prevent this problem. The fixing openings of the pad of FIG. 5 can cooperate with the projections of the holder according to FIGS. 6*a*, 6*b*. It will be clear that the fixing openings of the pad of FIG. 5 must be arranged rotated through 45.degree. in the plane of the drawing relative to the pad so that they are situated at the bulge 7 in order that the pad can also be used with the holder according to FIGS. 8*a* and 8*b*.

In FIG. 9, again, an alternative embodiment of the pad according to FIG. 1 is shown, while FIG. 9, again, shows a bottom view of the bottom sheet 4. Here too, it holds that an area 10 of the covering is designed to be at least virtually impermeable to water while the area comprises at least one annular sub-area occupying at least a part of the sealing seam. In this example, the annular sub-area comprises at the bottom sheet an angular bottom sheet sub-area 14 coinciding with the sealing seam 8. Further, the area 10 extends outside the sealing seam 8 at predetermined positions 76. If, as in FIG. 2*a*, these predetermined positions were defined by those parts 15 of the annular bottom sheet sub-area extending outside the sealing seam, in FIG. 9, these parts or positions 76 are defined by a first strip-shaped bottom sheet sub-area 78 which extends at least along a part of the diameter 80 of the bottom sheet 4. The ends 82 of the first strip-shaped bottom sheet sub-area 78 are located in or, in this example, are adjacent to a part of the sealing seam. The pad comprising the bottom sheet of FIG. 9 can, again, have a side view as shown in FIG. 1. The top sheet can, again, have any embodiment as discussed hereinabove. The top sheet may also have a top plan view as discussed with reference to the bottom view of FIG. 9.

Figure 9:
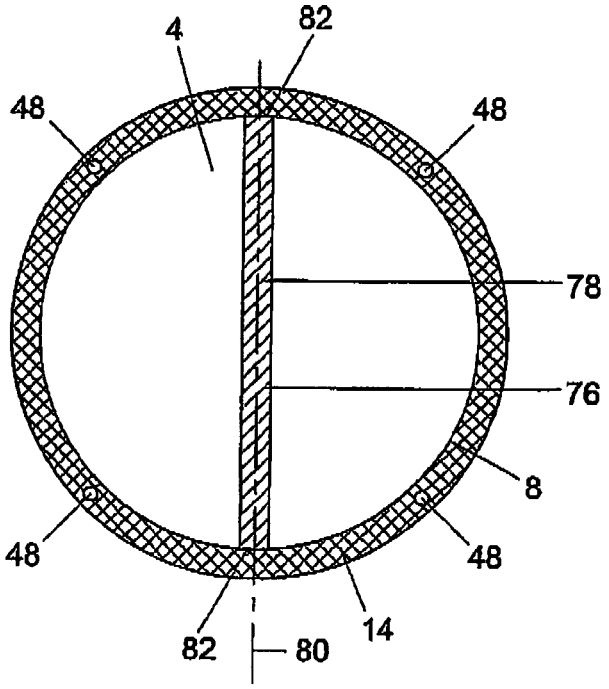
FIG. 9 shows a bottom view of a sixth embodiment of a pad according to the invention.
Figure 10B:
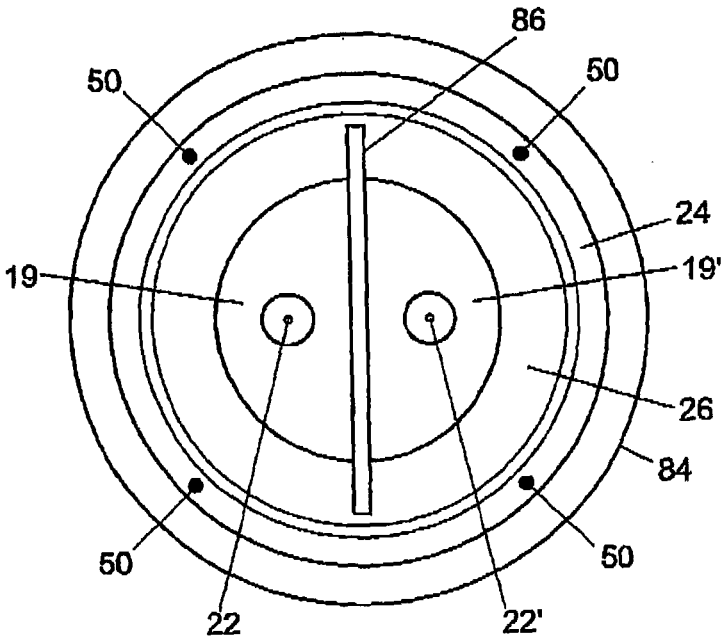
FIG. 10*b* shows a top plan view of the holder of FIG. 10*a;*
Figure 10A:
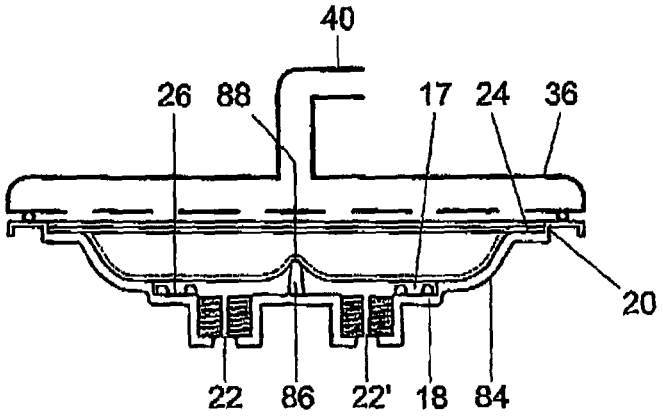
FIG. 10*a* shows a cross section of a third embodiment of an assembly comprising a holder an a pad according to the invention.

The pad comprising the bottom sheet of FIG. 9 can, again, be provided with indentations 46 and/or fixing openings. The pad of FIG. 9 can, for instance, be utilized in a pad holder 84 as shown in FIG. 10*a*. FIG. 10*b* shows a top plan view of the pad holder 84. In FIG. 10*a*, in addition to a cross-section of the pad holder 84, it is also shown how the pad according to FIG. 9 is included in the holder 84, while the projections 50 of the holder reach into the fixing openings 48. The holder 84 is provided with a bottom 18 and an upstanding sidewall 20 which, in combination, bound an inner space 17 of the holder. Once more, the bottom is composed of an outside bottom part 24 and an inside bottom part 26. In the bottom, a first outlet opening 22 and a second outlet opening 22' are provided. Between the outlet openings 22 and 22', the holder is provided with an upstanding edge (partition wall) 86 while a top side 88 of the upstanding edge is lower than the outside bottom part 24. If the pad of FIG. 1, which is provided with the bottom sheet of FIG. 9, is placed into the holder 84, the first strip-shaped bottom sheet sub-area of 78 will come to rest on top of the upstanding edge 86. Thereupon, the assembly of pad and holder is closed off with the aid of a lid 36 as described hereinabove. It is further noted that the upstanding edge 86 in fact subdivides the inside space 17 of the holder 84 in an inner space 19 and 19', while the inside space 19 is provided with the outflow opening 22 and the inner space 19' is provided with the outflow opening 22'.

When, hereupon, hot water is fed under pressure to the water inlet 40, the water will be pressed via the upper sheet through the coffee bed. The thus formed coffee extract will be supplied in at least virtually equal parts to the outflow opening 22 and the outflow opening 22', respectively. Here, the first strip-shaped bottom sheet sub-area 76 forms a seal with the upstanding edge 86, thereby contributing to the coffee extract being equally divided over both outflow openings 22 and 22'. In the holder of FIG. 10*a*, the upstanding edge 86 can also be omitted. In that case, too, the strip-shaped bottom sheet sub-area 78 will contribute to the coffee extract being equally divided over both outflow opening is 22 and 22'.

Figure 11:
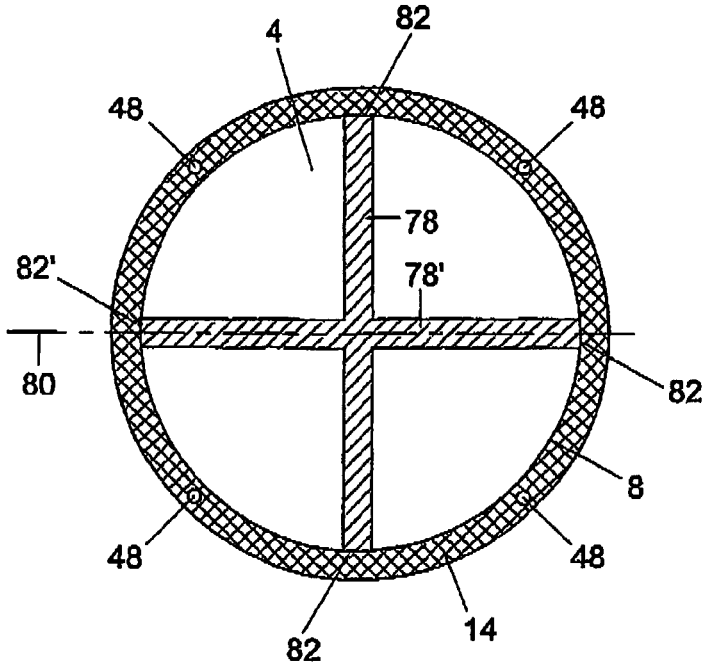
FIG. 11 shows a bottom view of a seventh embodiment of a pad according to the invention.
Figure 12:
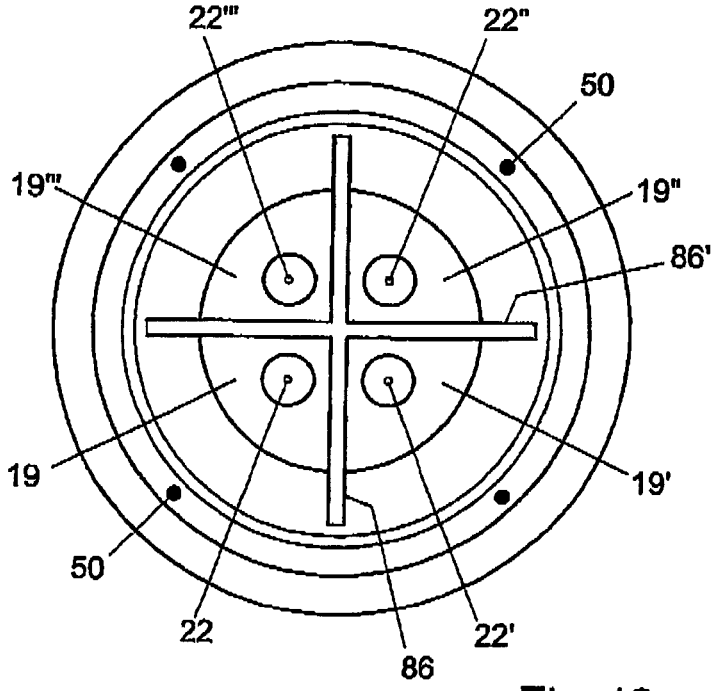
FIG. 12 shows a top plan view of a holder in which the pad according to FIG. 11 can be included.

In FIG. 11, an alternative embodiment of a bottom sheet 4 of the pad according to FIG. 1 is shown. Here, parts corresponding with FIG. 9 are provided with the same reference numerals. Furthermore, the bottom sheet according to FIG. 11 is provided with a second strip-shaped bottom sheet sub-area 78' belonging to the area 10, extending along at least a part of the diameter 80' of the bottom sheet 4. Again, it holds that the ends 82' of the second strip-shaped bottom sheet sub-area extend into or border on a part of the sealing seam 8. It further holds that the first strip-shaped bottom sheet sub-area 78 and a second strip-shaped bottom sheet sub-area 78' include an angle different from zero which, in this example, is at least virtually equal to 90.degree. It therefore holds that in this example, a first strip-shaped bottom sheet sub-area and the second strip-shaped bottom sheet sub-area intersect. The pad of FIG. 11 can be used in a holder, a top plan view of which is shown in FIG. 12. The holder of FIG. 12 corresponds, broadly, to the holder according to FIG. 10*a*. However, it holds that the holder according to FIG. 12 is provided with a first upstanding edge 86 and a second upstanding edge 86'. The first and second upstanding edges 68, 68' include an angle which corresponds to the angle which is included by the first strip-shaped bottom sheet sub-area 78 and the second strip-shaped bottom sheet sub-area 78'. In this manner, the inside space 76 of the holder is subdivided into four inside spaces 19, 19', 19" and 19'". In the bottom, per sub-space 19-19'", one outflow opening 22-22'" is provided. If the pad of FIG. 11 is placed in the holder of FIG. 12, with the projections 50 again reaching into fixing opening 48, the first strip-shaped bottom sheet sub-area 78 will rest on top of the upstanding edge 86 while the second strip-shaped bottom sheet sub-area 78' will rest on the upstanding edge 86'. The holder of FIG. 12 is filled with the pad according to FIG. 11 and is closed off with a lid as shown in FIG. 10*a* in order that the coffee extract that is formed is distributed equally over the outflow openings 22-22'. The operation hereof is entirely analogous to that as discussed in relation to FIG. 10. In the holder of FIG. 12, the upstanding edges 86, 86' can also be omitted. In that case, too, the strip-shaped bottom sheet sub-areas 78, 78' contribute to the coffee extract being distributed equally over the four outflow openings.

Figure 13:
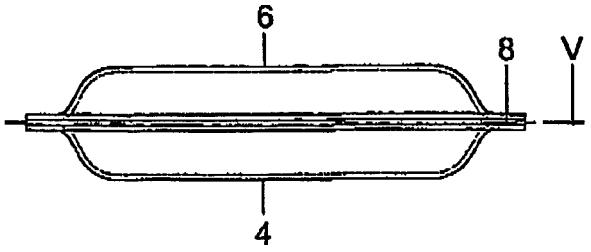
FIG. 13 shows a side view of an eighth embodiment of a pad according to the invention.

In each of the embodiments outlined hereinabove, it holds that the top sheet 6 is of flat design. In each of the embodiments outlined hereinabove, the bottom sheet is of cup-shaped design. However, it is also possible that the pad is designed to be at least virtually mirror symmetrical relative to a flat plane V through the sealing seam. A side view of such a pad is shown in FIG. 13.

Figure 14:
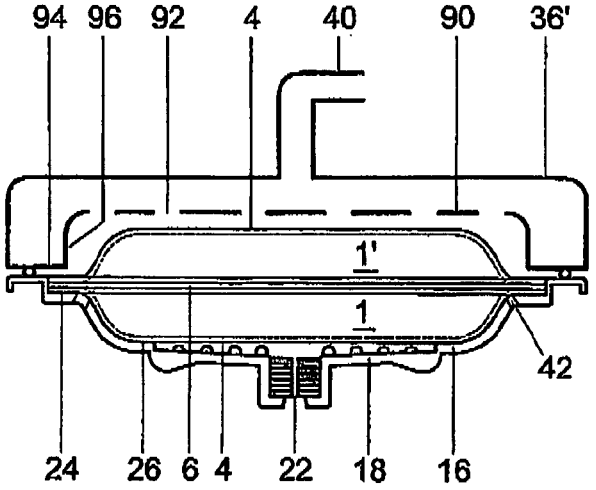
FIG. 14 shows a fourth embodiment of an assembly according to the invention comprising two pads according to the invention and a holder in which the two pads have been included.

In this example, the pads described hereinabove are filled with approximately 7 g of ground coffee. Then, such a pad is suitable for preparing approximately one consumption of coffee, that is to say 1 cup of coffee. With the embodiments of the pads as described hereinabove with reference to FIG. 1, it is further very well possible to simultaneously prepare two cups of coffee. All this is discussed with reference to FIG. 14. FIG. 14 shows a holder 16' in which two pads are included. The holder is provided with a bottom 18 comprising an inside bottom part 26 and an outside bottom part 24 as discussed hereinabove. The first pad 1 is positioned resting with its bottom sheet on the bottom. Here, the sealing seam 8 of the pad will reach over the outside bottom part 24. Further, a second pad 1', which is identical to the pad 1, is placed upside down on top of the pad 1. For the second pad 1' it therefore holds that it rests with its top sheet 6 on the top sheet 6 of the first pad 1. The assembly of FIG. 14 is further provided with a lid 36' for closing off the holder 16'. The lid 36' is provided, at the inside, with a bottom 90 having at least one water outlet opening 92. The bottom 90 of the lid is composed of a horizontally directed annular outside bottom part 92 and a dish-shaped inside bottom part 94 adjacent the inside edge 96 of the outside bottom part. Adjacent the outside bottom part, the inside bottom part extends upwards in a direction away from a side of the lid. The result is that the pad 1', as shown in FIG. 14, is included, at least virtually, in a space enclosed by the dish-shaped inside bottom part 94. Here, the annular outside bottom part 24 of the holder lies opposite the annular outside bottom part 94 of the lid 36'. The two sealing seams 8 of the two pads 1, l' are situated (optionally not clamped, as in this example) between the outside bottom parts of the holder and the lid. When, with the apparatus according to FIG. 14, hot water is fed to water inlet 40, this water will be pressed through the two pads 1, l' whereupon the coffee extract will leave the holder via the outlet opening 22. In this example, the amount of water that is fed to the water inlet 40 will be approximately twice as large as the amount discussed in relation to FIGS. 7 and 8*a*. It further appears that the pads, which are each provided with the area 10, cooperate such that the risk of bypass is strongly reduced and the coffee-making efficiency is optimized. According to the invention, with the assembly according to FIG. 14, each of the pads can also not be provided with the areas 10. More in general, it then holds that the assembly comprises two pads and one holder while the pads are each provided with a flat top sheet and a bottom sheet which are interconnected adjacent their longitudinal edges, while the pads are filled with a product to be extracted and/or a product to be dissolved, the two pads being included in the holder, the holder being provided with a bottom and an upstanding sidewall while in the bottom at least one outflow opening is provided, a first pad of the pads resting with its bottom sheet on the bottom and a second pad of the two pads resting with its top sheet on the top sheet of the first pad.

For each of the exemplary embodiments outlined hereinabove it holds that the area of the bottom sheet can be realized in various manners. For instance, the bottom sheet can consist of a nonwoven material which has undergone a heat treatment in the area. It is also possible that the bottom sheet comprises a coating which has undergone a heat treatment in the area of the bottom sheet. This coating may then have been applied to both an outside of the bottom sheet (this is the side of the bottom sheet forming the outside of the pad) and an inside of the bottom sheet. It is also possible that the area of the bottom sheet comprises a coating which is at least virtually impermeable to water. This coating may, again, be applied both to the inside of the bottom sheet and to the outside of the bottom sheet. In each of these examples, the bottom sheet itself may have been manufactured from filtering paper. It is further possible that the bottom sheet is manufactured from, for instance, filtering paper and that the area of the bottom sheet comprises an additional film which has been applied to the filtering paper at the inside and/or at the outside of the bottom sheet. Here, this additional film is of the type that is at least virtually impermeable to water. It is also conceivable that the bottom sheet is manufactured from a material that is at least virtually impermeable to water, which has been perforated for obtaining a filter. At the location where the perforation is missing, the bottom sheet is provided with the area 10 mentioned. Whatever holds for the bottom sheet, holds entirely analogously for the top sheet. For instance, the top sheet too can comprise a non-woven material which has undergone a heat treatment in the area. This top sheet can be combined with a similar type of bottom sheet or with a different type of bottom sheet, to be formed into a pad. Thus, the top sheet may have been manufactured from the non-woven material which has undergone a heat treatment in the area while the bottom sheet is manufactured from a material which is at least virtually impermeable to water and which is perforated for obtaining a filter. Each of these combinations is a possibility. The top sheet too can therefore be provided with a coating which, in the area of the top sheet, has undergone a heat treatment. It is also conceivable that the area of the top sheet comprises a coating which is at least virtually impermeable to water. It is also possible that the area of the top sheet comprises an additional film applied to the filtering paper at an inside and/or at an outside of the pad and which is at least virtually impermeable to water. It is also possible that the top sheet is manufactured from a material which is at least virtually impermeable to water which is perforated for obtaining a filter. In each of the embodiments described hereinabove, it holds that the pad is of the flexible type. This means that in this example, the product in the pad has not been compressed to form a solid whole and hence has some freedom of movement within the covering and that the covering is not rigid. The pad may however be provided with a compressed product.

In the embodiments outlined hereinabove it therefore holds that the covering is designed to be flexible. This has the advantage that, in use, the pad can adjust to the shape of the holder as a result of which the pad will link up well to the bottom of the holder so that the above-outlined cooperation between pad and holder can be realized in an optimal manner. When it further holds that the product has not been compressed, this has as an advantage that the product itself can adjust relatively rapidly to the shape of the holder. This will be somewhat more difficult when, conversely, the product has been compressed, and will typically only occur if hot water is fed to the pad.

However, it is preferred that the pad is designed to be flexible. When the pad is designed to be flexible, this entails that the covering is of flexible design and that furthermore, the product has not been compressed.

It could be so that the sealing seam and/or the areas have more rigid properties than the rest of the pad. In that example, it holds that the covering outside the sealing seam is designed to be at least substantially flexible. When the areas too are flexible, it then holds that the covering outside the sealing seam is designed to be flexible, and when the areas are rigid (not flexible) it holds that the covering outside the sealing seam is designed to be substantially flexible. In that case too, the above-outlined use of the various embodiments of the pad can be realized well. In particular, it holds that the surface of the predetermined positions where the area extends outside the sealing seam is relatively small with regard to the surface of the covering outside the sealing seam and outside the area. Relatively small is for instance understood to mean that the surface of the predetermined positions where the area extends outside the sealing seam is smaller than 50% of the surface of the covering outside the sealing seam and outside the area. In particular, the percentage is smaller than 40 percent and, preferably, smaller than 25 percent. If, in that case, the area were to have the property that it is more rigid than the rest of the covering, it has been achieved that in use, the pad as a whole can still take the shape of the holder as described hereinabove. Taking the shape is understood to mean, inter alia, that the pad as such already has a shape that fits the holder well, but because the pad is for instance substantially not rigid, but at least substantially flexible, the pad can still, at a level of details, differ from the shape of the holder and can thus, in use, adjust its shape.

The fact that it is preferred that the covering is designed to be at least substantially flexible, entails, for instance, that the bottom and top sheet are each manufactured from a flexible material such as filtering paper, and that the area has properties such that also there, where the area is present, the covering remains not rigid but flexible, i.e. relatively easily deformable and bendable. Here, the sealing seam is also flexible.

Preferably, it also holds for each of the outlined embodiments that the top sheet outside the sealing seam rests on the product, at least substantially. This allows the pad to be suitable to be placed in a holder while the liquid, more in particular the hot water, is fed under pressure to the holder for the purpose of being pressed through the holder. If the top sheet were not to substantially rest on the product, in use, the top sheet could tear and the pad is unsuitable, or less suitable, to be used under pressure.

It is preferred that the pad be filled with a product to be extracted such as, for instance, ground coffee or tea. In that case, the pad may, optionally, further be filled with a product to be dissolved such as a creamer, cocoa or other substances such as flavourings, colorants etc.

Further, the pressure limit openings can be provided entirely in the outside bottom part and/or entirely in the inside bottom part. Also, instead of being circular, the pads can have a different shape such as oval, n-angular (N greater than or equal to three), et cetera Annular is therefore also understood to include these shapes. Such variants are each understood to fall within the framework of the invention.

What is claimed is:

1. A pad containing a coffee product to be extracted for preparing a beverage, the pad comprising:

a substantially flexible bottom sheet manufactured from filtering paper and having a circumferential edge, and a substantially flexible top sheet manufactured from filtering paper and having a circumferential edge, wherein the top sheet and the bottom sheet are interconnected at their circumferential edges to form a covering with a circumferential sealing seam with the coffee product situated between the top sheet and the bottom sheet, wherein the bottom sheet and the top sheet each form a filter which is substantially impermeable to the product and which is permeable to water, wherein the covering outside the sealing seam is substantially flexible, wherein the covering includes an impermeable area that is substantially impermeable to water, the impermeable area is disposed along an annular portion of the sealing seam and extends from the annular portion of the sealing seam over only a limited portion of the bottom sheet, limited to ensure that the bottom sheet remains permeable to water, wherein the annular impermeable area comprises, at the bottom sheet, an annular bottom sheet sub-area which extends radially inside the sealing seam, wherein part of the impermeable sub-area that extends radially inside the sealing seam is adjacent to the coffee product at the bottom sheet, and wherein the annular impermeable area extends only adjacent to the coffee product at the bottom sheet, wherein the annular impermeable area is further provided with at least one of a fixing opening and an indentation, so that in use the pad can be accurately positioned in a holder having at least one co-operating projection to ensure that in use, the area that extends inwardly of the sealing seam is configured to cover at least one pressure limit opening of the holder and to allow water to flow under the annular impermeable area to the at least one pressure limit openings to discharge water and have the pressure in the holder rise no further only when the pressure in the holder will increase to a threshold pressure, which causes the pressure drop across the pad to be very small, and the pad and annular impermeable area are no longer firmly pressed against the bottom.

2. The pad according to claim 1, wherein the annular bottom sheet sub-area is part of the sealing seam.

3. The pad according to claim 2, wherein the annular bottom sheet sub-area provides a first annular seam part of the sealing seam.

4. The pad according to claim 3, wherein the sealing seam comprises a second annular seam part which embraces the first annular seam part and outside of the at least substantially water impermeable area of the bottom sheet.

5. The pad according to claim 1, wherein the annular bottom sheet sub-area forms the entire sealing seam.

6. The pad according to claim 1, wherein the annular bottom sheet sub-area extends along the sealing seam and provides at least a part of the sealing seam, wherein the area further comprises, at the bottom sheet, parts forming the annular impermeable portion at an inside edge of the bottom sheet sub-area inwardly of the sealing seam.

7. The pad according to claim 1, wherein the area comprises, at the bottom sheet, an elongate first strip-shaped bottom area sub-area, which extends diametrically of the bottom sheet.

8. The pad according to claim 7, wherein the ends of the first strip-shaped bottom sheet sub-area are located in or are adjacent to a part of the sealing seam.

9. The pad according to claim 8, wherein the area of the bottom sheet comprises an elongate second strip-shaped bottom sheet sub-area, which extends diametrically of the bottom sheet.

10. The pad according to claim 9, wherein the ends of the second strip-shaped bottom sheet sub-area are located in or are adjacent to a part of the sealing seam.

11. The pad according to claim 10, wherein the first strip-shaped bottom sheet sub-area and the second strip-shaped bottom sheet sub-area include an angle different from zero.

12. The pad according to claim 11, wherein said angle is substantially equal to 90 degrees.

13. The pad according to claim 9, wherein the first strip-shaped bottom sheet sub-area and the second strip-shaped bottom sheet sub-area intersect.

14. The pad according to claim 1, wherein the bottom sheet comprises a non-woven material which has undergone a heat treatment in the area.

15. The pad according to claim 1, wherein the bottom sheet comprises a coating which has undergone a heat treatment in the area of the bottom sheet.

16. The pad according to claim 1, wherein the area of the bottom sheet comprises a coating which is at least substantially impermeable to water.

17. The pad according to claim 1, wherein the area of the bottom sheet comprises an additional film which is applied to the bottom sheet consisting of filtering paper at one of the inside and the outside of the pad and which is at least substantially impermeable to water.

18. The pad according to claim 1, wherein the bottom sheet is manufactured from a material that is at least substantially impermeable to water, which is perforated for obtaining a filter.

19. The pad according to claim 1, wherein the bottom sheet is substantially cup-shaped.

20. The pad according to claim 19, wherein the pad is substantially symmetrical across a flat plane extending through the sealing seam.

21. The pad according to claim 1, wherein the top sheet is substantially flat.

22. The pad according to claim 1, wherein the covering is flexible.

23. The pad according to claim 1, wherein the pad is flexible.

24. The pad according to claim 1, wherein the surface of the predetermined positions where the area extends outside the sealing seam is relatively small with regard to the surface of the covering outside the sealing seam and outside the area.

25. The pad according to claim 1, wherein the top sheet outside the sealing seam rests, at least substantially, on the product.

26. A pad and holder assembly for making a beverage, the assembly comprising:

a pad filled with at least one of a coffee product to be extracted and a creamer product to be dissolved by hot water during use for preparing a beverage, the pad having a bottom sheet manufactured from filtering paper and a top sheet manufactured from filtering paper, the top sheet and the bottom sheet interconnected at their circumferential edges to form a covering with a circumferential sealing seam with the product situated between the top sheet and the bottom sheet such that the bottom sheet and the top sheet each form a filter which is at least substantially impermeable to the product and which is at least permeable to water, the pad comprises at least one annular bottom sheet sub-area which is impermeable to water, wherein the least one annular bottom sheet sub-area is disposed along an annular portion of the sealing seam and extends radially inside the sealing seam over only a limited portion of the bottom sheet a holder having a bottom and an upstanding sidewall, the bottom having at least one outflow opening, the pad resting on the bottom, wherein the bottom of the holder includes at least one pressure limit opening and positioned to cooperate with the at least one annular bottom sheet sub-area of the pad, wherein the at least one annular bottom sheet sub-area of the pad seam covers the at least one pressure limit opening in the holder and is configured to only open and release pressure when a threshold pressure is reached in the holder, and wherein the impermeable at least one annular bottom sheet sub-area area does not extend over the top sheet.

27. A pad filled with at least one of a product to be extracted and a product to be dissolved for preparing a beverage and is configured to be placed in a holder having a bottom with at least one pressure limit opening therein so that in use hot water is provided under pressure to the pad the pad comprising:

a substantially flexible bottom sheet and a substantially flexible top sheet, the top sheet and the bottom sheet each having an outer edge being interconnected at their outer edges so that a covering with a circumferential sealing seam is formed with the at least one product situated between the top sheet and the bottom sheet, the bottom sheet and the top sheet each form a filter which is substantially impermeable to the at least one product and which is permeable to water, wherein the covering outside the sealing seam is substantially flexible, wherein the pad in use rests on the bottom of the holder, wherein the covering includes an impermeable area that is substantially impermeable to water and is disposed along an annular portion of the sealing seam, wherein the impermeable area comprises at least one of:

at least one annular impermeable sub-area extending outside the sealing seam at predetermined positions; and a plurality of impermeable sub-areas separate from each other and extending outside the sealing seam at predetermined positions, and wherein the impermeable area at the bottom sheet covers the at least one pressure limit opening of the holder when the pad is received in the holder;

wherein the at least one annular sub-area comprises, at the bottom sheet, an annular bottom sheet sub-area which extends inside and outside the sealing seam; and wherein the annular impermeable portion does not extend over the top sheet.

28. The pad according to claim 26, wherein the annular bottom sheet sub-area forms at least a part of the sealing seam.

29. The pad according to claim 28, wherein the annular bottom sheet sub-area provides a first annular seam part of the sealing seam.

30. The pad according to claim 27, wherein the annular bottom sheet sub-area extends along the sealing seam and provides at least a part of the sealing seam, wherein the impermeable area further comprises, at the bottom sheet, parts forming the at least one annular impermeable sub-area at an inside edge of the annular bottom sheet sub-area outside the sealing seam.

31. The pad according to claim 27, wherein the impermeable area of the covering comprises, at the bottom sheet, a first strip-shaped bottom sheet sub-area which extends along at least a part of a diameter of the bottom sheet.

32. The pad according to claim 27, wherein the impermeable area of the covering comprises an annular top sheet sub-area extending out from the sealing seam across a portion of the top sheet.

33. The pad according to claim 32 wherein the annular top sheet sub-area is disposed across the entire sealing seam.

34. The pad according to claim 32, wherein the annular top sheet sub-area covers a part of the sealing seam.

35. The pad according to claim 27, wherein the at least one annular sub-area comprises, at the top sheet, an annular bottom sheet sub-area extending along the sealing seam while the impermeable area further comprises, at the top sheet, parts forming the at least one annular impermeable sub-area at an inside edge of the top sheet outside the sealing seam.

36. The pad according to claim 27, wherein the top sheet comprises an annular top sheet part of which first ring segments form part of the impermeable area at the top sheet and second ring segments are located outside of the impermeable area at the top sheet, the first and second ring segments of the annular top sheet part together forming the annular top sheet part while the annular top sheet part extends along the sealing seam and provides at least a part of the sealing seam.

37. The pad according to claim 36, wherein one segment of the first ring segments of the annular top sheet part borders, on both sides, on segments of the second ring segments of the annular top sheet part.

38. The pad according to claim 36, wherein the annular top sheet part covers the entire sealing seam.

39. The pad according to claim 36, wherein the annular top sheet part is part of the sealing seam.

40. The pad according to claim 36, wherein the annular top sheet part extends out from the sealing seam across a portion of the top sheet.

41. The pad according to claim 27, wherein the plurality of sub-areas separate from each other each extend partly along an inside of and partly outside the sealing seam.

42. The pad according to claim 27, wherein the plurality of sub-areas separate from each other each extend along an inside of the sealing seam.

43. The pad according to claim 27, wherein the plurality of sub-areas separated from each other each extend outside the sealing seam.

44. The pad according to claim 27, wherein the plurality of sub-areas extend at the bottom sheet of the covering.

45. The pad according to claim 27, wherein the impermeable area of the covering at the bottom sheet comprises a coating which is at least substantially impermeable to water.

46. The pad according to claim 27, wherein the impermeable area of the covering at the bottom sheet comprises an additional film which is applied to the filtering paper at, at least one of the inside and the outside of the pad and which additional film is at least substantially impermeable to water.

47. The pad according to claim 27, wherein the bottom sheet is manufactured from a material that is at least substantially impermeable to water, which is perforated for obtaining a filter.

48. The pad according to claim 27, wherein the impermeable area of the covering at the top sheet comprises a coating which is at least substantially impermeable to water.

49. The pad according to claim 27, wherein the impermeable area of the covering at the top sheet comprises an additional film which is applied to the filtering paper at, at least one of the inside and the outside of the pad and which is at least substantially impermeable to water.

50. The pad according to claim 27, wherein the top sheet is manufactured from a material that is at least substantially impermeable to water, which is perforated for obtaining a filter.

51. The pad according to claim 27, wherein the bottom sheet is arranged to be at least substantially cup-shaped.

52. The pad according to claim 51, wherein the pad is substantially symmetrical across a flat plane extending through the sealing seam.

53. The pad according to claim 27, wherein the top sheet is arranged to be at least substantially flat.

54. The pad according to claim 27, wherein the covering is arranged to be flexible.

55. The pad according to claim 27, wherein the pad is arranged to be flexible.

56. The pad according to claim 27, wherein the top sheet outside the sealing seam rests, at least substantially, on the at least one product.

57. The pad according to claim 27, being arranged for placement in the given holder that has at least one projection in addition to the at least one pressure limit opening therein, and the pad further being provided with at least one of a fixing opening and an indentation for accommodating the projection and for accurately positioning the pad in respect of the at least one pressure limit opening of the given holder.

58. The pad according to claim 9, wherein each of the elongate first strip-shaped bottom sheet sub-area and the elongate second strip-shaped bottom sheet sub-area are positioned only on a surface of the bottom sheet.

* * * * *